US005550956A

United States Patent [19]

Tadokoro

[11] Patent Number: 5,550,956

[45] Date of Patent: Aug. 27, 1996

[54] COLOR PRINTER

[75] Inventor: Hiroyuki Tadokoro, Hitachi, Japan

[73] Assignee: Hitachi, Ltd., Tokyo, Japan

[21] Appl. No.: 58,133

[22] Filed: May 10, 1993

[30] Foreign Application Priority Data

May 11, 1992 [JP] Japan ..... 4-117619

[51] Int. Cl.[6] ..... C06K 15/00

[52] U.S. Cl. ..... 395/113; 395/108

[58] Field of Search ..... 395/113, 108, 395/109, 519, 110, 114, 117, 101, 112, 111, 108

[56] References Cited

U.S. PATENT DOCUMENTS 4,994,986 2/1991 Cihiwsky et al. ..... 364/519
5,168,292 12/1992 Kadowaki et al. ..... 346/157
5,175,804 12/1992 Wittmann ..... 395/108
5,276,779 1/1994 Statt ..... 395/109
5,285,296 2/1994 Komooka et al. ..... 358/518
5,313,291 5/1994 Appel et al. ..... 358/501

*Primary Examiner*—Raymond J. Bayerl
*Assistant Examiner*—Steven P. Sax
*Attorney, Agent, or Firm*—Antonelli, Terry, Stout & Kraus

[57] ABSTRACT

The color printer of the present invention includes a memory for storing latest history information of a print-out means, a controller for judging the worn conditions of expendable members on the basis of the history information and for generating maintenance information image data wherein expendable members which are before the exchange time and expendable members which are after the exchange time are sorted in different colors, and an operator panel for printing the maintenance information image data on a recording medium in color by the print-out means. According to the present invention, maintenance information necessary for performing maintenance and inspection or for exchanging expendable members can be outputted in a color image form which is color-coded quite obviously.

20 Claims, 16 Drawing Sheets

FIG. 4

| | |
|---|---|
| NEWDATA (Y) | TOTAL NUMBER OF Y DEVELOPER OPERATED PAGES |
| NEWDATA (M) | TOTAL NUMBER OF M DEVELOPER OPERATED PAGES |
| NEWDATA (C) | TOTAL NUMBER OF C DEVELOPER OPERATED PAGES |
| NEWDATA (K) | TOTAL NUMBER OF K DEVELOPER OPERATED PAGES |
| NEWDATA (P) | TOTAL NUMBER OF PASSED PAPERS |

31

| | |
|---|---|
| REVDATA (DY) | LATEST HISTORY INFORMATION OF Y DEVELOPER |
| REVDATA (DM) | LATEST HISTORY INFORMATION OF M DEVELOPER |
| REVDATA (DC) | LATEST HISTORY INFORMATION OF C DEVELOPER |
| REVDATA (DK) | LATEST HISTORY INFORMATION OF K DEVELOPER |
| REVDATA (BU) | LATEST HISTORY INFORMATION OF PHOTOSENSITIVE BELT |
| REVDATA (FU) | LATEST HISTORY INFORMATION OF FIXER |
| REVDATA (CU) | LATEST HISTORY INFORMATION OF CHARGER |
| REVDATA (TU) | LATEST HISTORY INFORMATION OF TRANSFER DEVICE |

32

FIG. 5

| | |
|---|---|
| FIXDATA (DY) | FIXED NUMBER FOR EXCHANGE PERIOD OF Y DEVELOPER |
| FIXDATA (DM) | FIXED NUMBER FOR EXCHANGE PERIOD OF M DEVELOPER |
| FIXDATA (DC) | FIXED NUMBER FOR EXCHANGE PERIOD OF C DEVELOPER |
| FIXDATA (DK) | FIXED NUMBER FOR EXCHANGE PERIOD OF K DEVELOPER |
| FIXDATA (BU) | FIXED NUMBER FOR EXCHANGE PERIOD OF PHOTOSENSITIVE BELT |
| FIXDATA (FU) | FIXED NUMBER FOR EXCHANGE PERIOD OF FIXER |
| FIXDATA (CU) | FIXED NUMBER FOR EXCHANGE PERIOD OF CHARGER |
| FIXDATA (TU) | FIXED NUMBER FOR EXCHANGE PERIOD OF TRANSFER DEVICE |

33

FIG. 12

STATUS REPORT OF EXCHANGED PARTS

YELLOW DEVELOPER

MAGENTA DEVELOPER

CYAN DEVELOPER

BLACK DEVELOPER

PHOTOSENSITIVE BELT

CHARGER

TRANSFER DEVICE

FIXER

RED CHARACTER : PARTS NEED TO EXCHANGE

GREEN CHARACTER : PARTS NEED NOT TO EXCHANGE

CONTENT OF HISTORY INFORMATION

YELLOW : 25,000 PAGES

MAGENTA : 10,000 PAGES

CYAN : 15,000 PAGES

BLACK : 20,000 PAGES

TOTAL PAGES OF IMAGE : 70,000 PAGES

TOTAL NUMBER OF PASSED PAPERS : 40,000 SHEETS

1200

1210

COLOR PRINTER

BACKGROUND OF THE INVENTION

The present invention relates to a color printer for printing image data given from an external host computer or image data generated by itself and more particularly relates to a color printer and printer server for printing information suitable for maintenance thereof by itself.

BACKGROUND ART

A printer for printing color image data, for example, a printer indicated in the specification U.S. Pat. No. 4,682,190 requires repair of failure or supply and exchange of various expendable members so as to maintain the performance thereof. The maintenance and inspection operation for supply and exchange greatly affects the running cost of the color printer. Therefore, it is important to facilitate the maintenance and inspection operation so as to reduce the running cost of the color printer. To shorten the operation time of maintenance and inspection, it is advantageous to use the history information of the color printer. The history information can be divided broadly into the following two types.

(1) Failure information: Paper jamming information, etc.

(2) Maintenance information: Worn conditions (wear degrees) of expendable members such as photoconductors and developers To use such history information, it is necessary for an operator to confirm the history information. In the specification U.S. Pat. No. 4,586,147, a monochromatic printer which stores latest history information for maintenance and inspection in itself and which has a history information output section for printing out the above latest history information by itself using the intrinsic printing function of the printer when the information is necessary is indicated.

When a color printer is compared with a monochromatic printer, the types of ink, developers, and expendable members are increased and it is important to maintain the performance and characteristics of each component.

Therefore, various maintenance information is necessary. The exchange time of each expendable member is judged by an operator on the basis of the history information which is printed out by the printer. However, appropriate judgment of the exchange time from the history information printed requires a great deal of skill and a color printer which has various history information requires more sophisticated skill. Particularly, to allow a general unskilled user to perform the daily maintenance and inspection operation surely, it is desirable to modify and output the history information in a visible form.

SUMMARY OF THE INVENTION

An object of the present invention is to provide a color printer or printer server which can present latest maintenance information, which is necessary when performing the maintenance and inspection of the color printer or exchanging expendable members, to a general user in a form that it can be judged properly.

Another object of the present invention is to provide a method for presenting various maintenance information and history information of a color printer or printer server in a form that they can be seen easily by a user.

A characteristic of the present invention is that a color printer or printer server includes a memory means for storing latest history information of a print-out means, a worn condition judging section for judging the worn conditions of a plurality of expendable members of the above print-out means on the basis of the history information, a maintenance information image data generating section for sorting the above plurality of expendable members into a group of expendable members which are before the exchange time and another group of expendable members which are after the exchange time and for generating maintenance information image data in different colors, and a maintenance information output section for outputting the above maintenance information image data to the print-out means or display section.

Another characteristic of the present invention resides in the following steps; storing the maintenance information output method of the color printer or printer server the latest history information of the above print-out means in the memory means, judging the worn conditions of a plurality of expendable members of the above print-out means on the basis of the above history information, storing the above plurality of expendable members into expendable members which are before the exchange time and expendable members which are after the exchange time and generating maintenance information image data with different colors assigned, displaying the above maintenance information image data in color by the printing section or display section.

According to the present invention, various maintenance information necessary for performing the maintenance and inspection of the color printer or printer server or for exchanging expendable members can be outputted in a color image form which is color-coded quite obviously. Therefore, a user can perform the maintenance and inspection operation or the exchange operation of expendable members efficiently and precisely and the maintenance operation cost can be reduced.

BRIEF DESCRIPTION OF THE DRAWINGS

FIG. 4 is a memory allocation diagram of a part of the nonvolatile memory shown in FIG. 3.

FIG. 5 is a memory allocation diagram of a part of the ROM of the controller shown in FIG. 3.

FIG. 12 is an illustration of an information print-out image example using characters.

DETAILED DESCRIPTION

Next, the color printer of the present invention will be explained with reference to the accompanying drawings.

Figure 1:
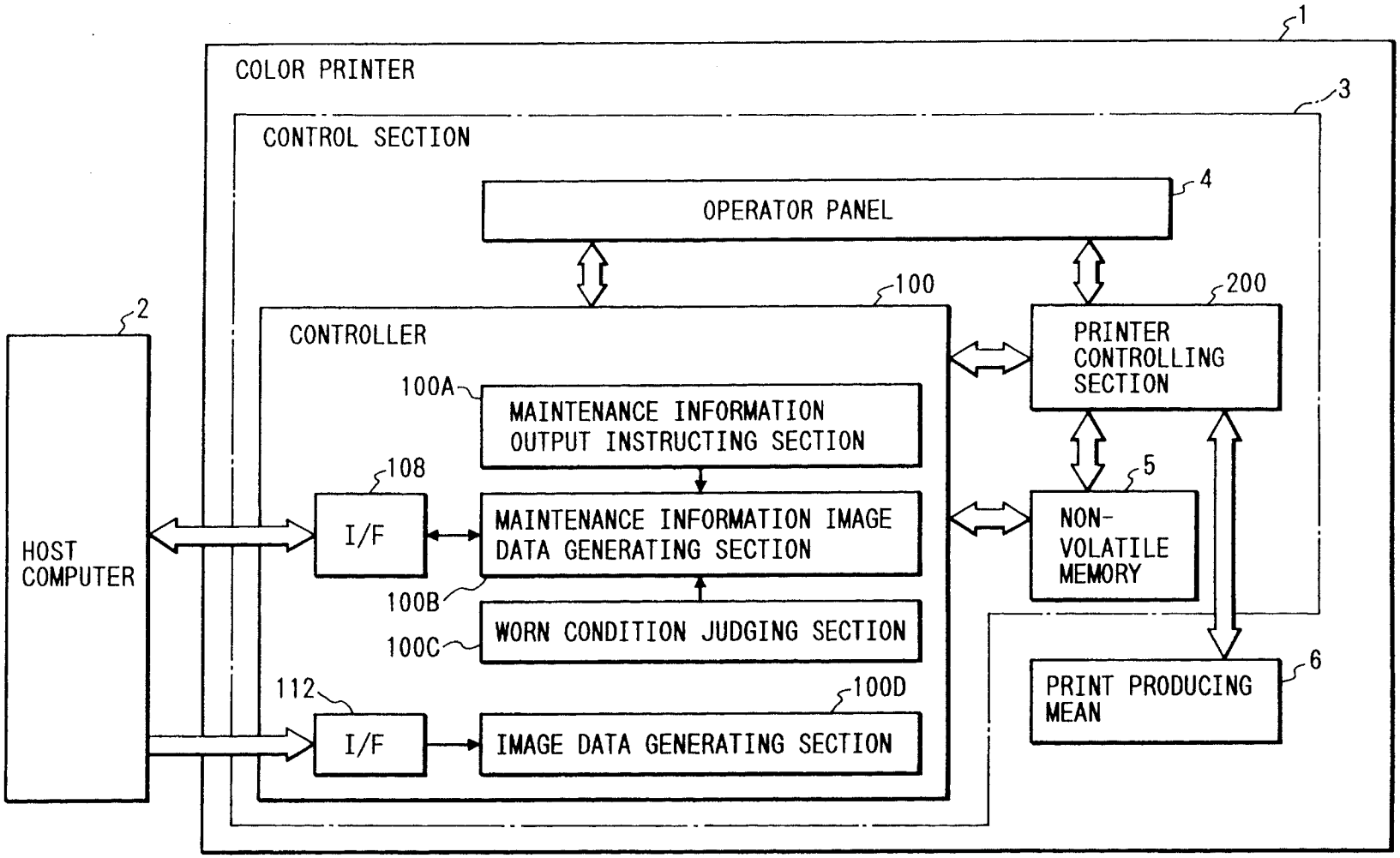
FIG. 1 is a drawing showing the entire structure of a color printer of an embodiment of the present invention.

FIG. 1 is a block diagram showing the basic structure of the color printer of the present invention. Numeral 1 indicates a color printer and 2 a host computer such as a personal computer, workstation, or word processor. The color printer 1 includes a control section 3 for processing color print data, an operator panel 4, and a print producing means 6. The control section 3 includes a controller 100, a printer controlling section 200, and a memory 5. The controller 100 expands image data given from the host computer 2 or image data which is generated by itself to print image (dot) data in each color.

The controller 100 includes a maintenance information output instructing section 100A, a maintenance information image data generating section 100B, a worn condition judging section 100C, and an image data generating section 100D. Numerals 108 and 112 indicate interfaces.

The printer controlling section 200 and print producing means 6 constitute a print-out means. This print-out means superimposes toner images in each color formed according to the image data in each color one by one so as to form a color toner image and transfers and fixes the color toner image on a recording medium.

The print-out means has various expendable members and exchange members and it is necessary to supply or exchange the expendable members or exchange parts periodically or every a predetermined amount of printing. For example, an electrophotographic print producing means has expendable members and exchange members such as toners and photoconductors, and an ink jet type print producing means has expendable members such as ink cartridges, and a heat transfer type print producing means has expendable members such as ink ribbon cartridges, and a silver halide photographic print producing means has exchange members such as developers.

The exchange time of each expendable member or exchange member of the print-out means is judged by counting the number of sheets of recording media printed by the print-out means or the number of pages of processed color image data and storing the cumulative value thereof (hereinafter called the number of actual sheets), by converting the exchange time of each expendable member or exchange member to this number of sheets beforehand and setting the value (hereinafter called the number of scheduled exchange sheets), and by comparing the number of actual sheets with the number of scheduled exchange sheets. This method provides an advantage that there is no need to newly install a special hardware such as a counter. According to this embodiment, a storage means, that is, the non-volatile memory 5 is installed in the color printer 1 as a means for storing various latest history values including the number of actual sheets. The non-volatile memory 5 inputs the latest history values or latest maintenance values from the printer controlling section 200 and is connected so as to send the latest history values or latest maintenance values to the controller 100.

The operator panel 4 is connected to at least one of the controller 100 and the printer controlling section 200 of the print-out means so that an instruction of an operator can be transferred. The operator panel 4 has the following functions in addition to the operator panel function of a conventional printer. One of them is a function that when the maintenance and inspection of the color printer 1 are performed and any expendable member or exchange member is exchanged, an instruction for storing the latest maintenance value of the above member is given to the printer controlling section 200 and the other is a function that an instruction for printing maintenance information based on the latest history values and latest maintenance values which are necessary for performing the maintenance and inspection and exchanging any expendable member or exchange member on the recording medium is given to the controller 100.

The controller 100 which receives the instruction for outputting the maintenance information reads necessary information from the non-volatile memory 5 and performs the processing for judging the exchange time of each expendable member or exchange member used by the print producing means of the print-out means. From a result of this judgment processing, the controller 100 expands the name of each expendable member which is before the exchange time to image data with a color (for example, green) which provides a sense of safety, expands the name of each expendable member which is after the exchange time to image data with a color (for example, red) which requests care, and expands the other maintenance information to image data with a general color (for example, black). The color image data for maintenance information output expanded like this is printed in color on a recording medium by the print producing means 6.

Figure 2:
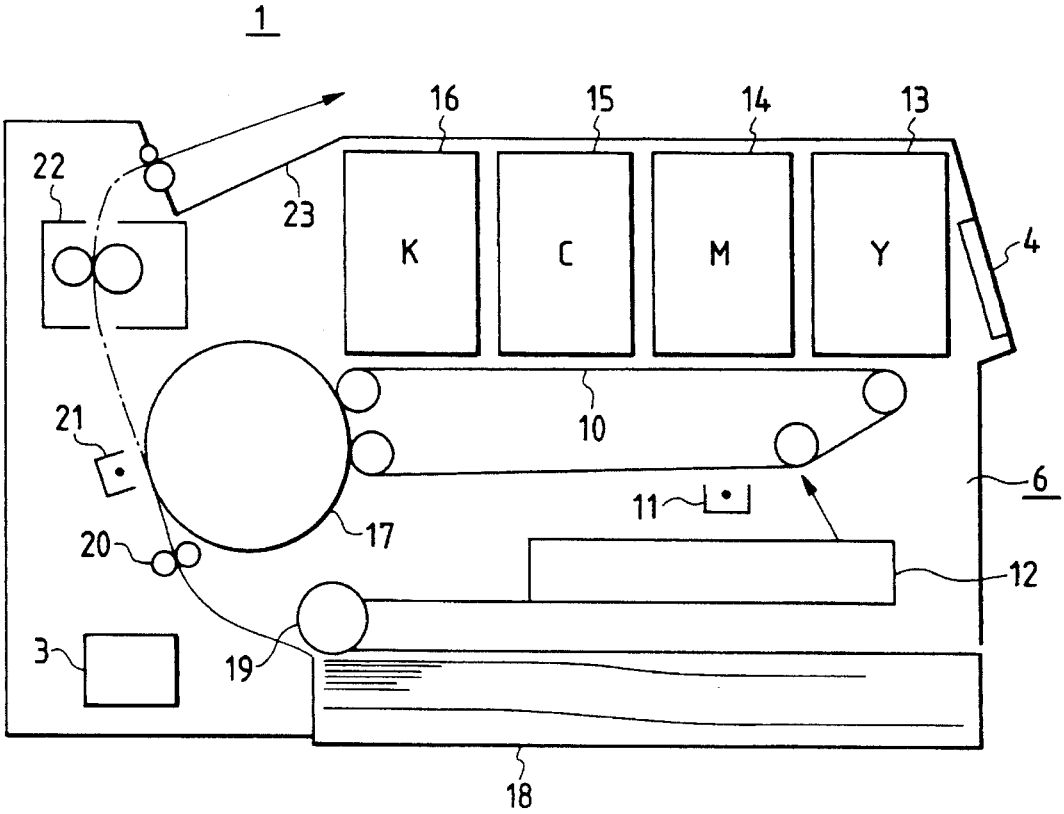
FIG. 2 is a longitudinal sectional view of the print producing means of the color printer shown in FIG. 1

FIG. 2 is a longitudinal sectional view showing an example of the structure of the print producing means of the color printer shown in FIG. 1. The color printer 1 is a printer using the electrophotographic process and includes a photosensitive belt 10 which is supported so as to rotate, a charger 11 for uniformly charging the surface of the photosensitive belt, and an optical information generator 12 for generating an exposure beam for forming an electrostatic latent image on the surface of the photosensitive belt which is uniformly charged according to the image data in each color. Numerals 13 to 16 indicate developers for converting an electrostatic latent image in each color to a corresponding toner image. The developer 13 is a developing unit using a developing solution containing a yellow (Y) toner, and the developer 14 is a developing unit using a developing solution containing a magenta (M) toner, and the developer 15 is a developing unit using a developing solution containing a cyan (C) toner, and the developer 16 is a developing unit using a developing solution containing a black (K) toner.

The color printer 1 also includes an intermediate transfer drum 17 for forming a color toner image by superimposing and transferring toner images in each color one by one, a paper cassette 18 where recording media for transferring the color toner image are loaded, a paper feed roller 19 for feeding the papers in the paper cassette 18 one by one, and paper transport rollers 20 for transporting the recording medium which is fed by the paper feed roller 19 in synchronization with the color toner image on the intermediate transfer drum 17.

Furthermore, the color printer 1 includes a transfer device 21 for transferring the color toner image on the above intermediate transfer drum 17 onto the recording medium which is fed by the paper transport rollers 20, a fixer 22 for fixing the color toner image, which is transferred onto the recording medium, on the above recording medium, and a paper ejection tray 23 for ejecting the recording medium on which the color toner image is fixed and a color image is printed.

Figure 3:
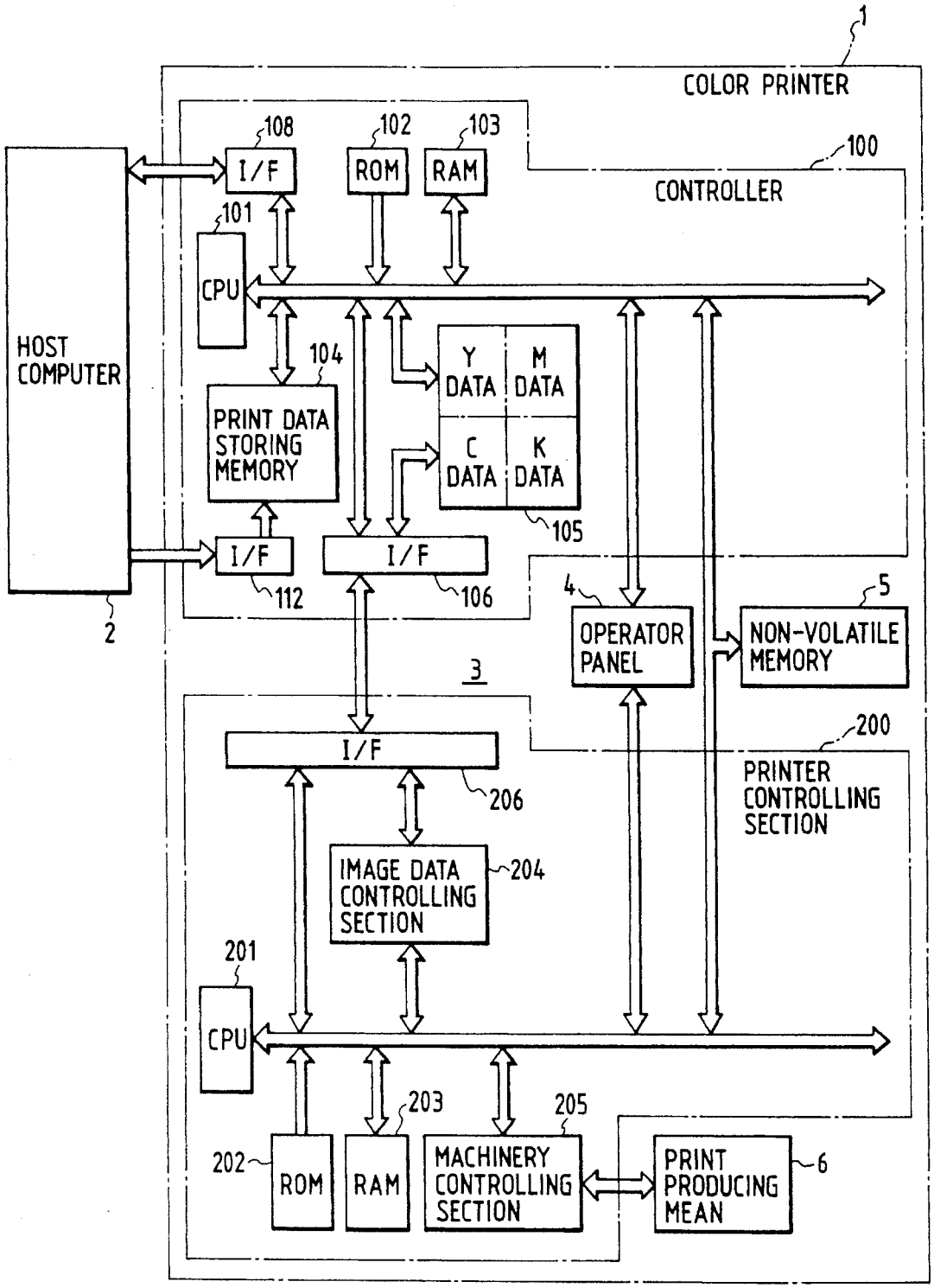
FIG. 3 is a block diagram of the control section of the color printer shown in FIG. 1.

Expendable (exchange) members of the color printer 1 are the developers 13 to 16, photosensitive belt 10, charger 11, fixer 22, and transfer device 21. Next, details of the control section 3 will be explained with reference to FIG. 3.

A controller 100 consists of a CPU 101, a ROM 102 for storing the control program of the CPU 101, and a RAM 103 as a work memory which is necessary for execution of the control program as key units. Furthermore, the controller 100 includes a print data storing memory 104 for storing print data which is received from a host computer 2, a bit map memory 105 for storing image data in each color which is obtained by expanding the print data, and an I/O interface 106 for communicating with a print-out means 200. The above print data consists of various data such as character data codes, graphic data vectors, and pixel data bits. The print data is expanded on the Y bit map memory, M bit map memory, C bit map memory, and K bit map memory as image data which is separated in each color on the bit map memory 105 by the CPU 101, ROM 102, and RAM 103 according to each data type. Image data in each color on the bit map memory 105 or a print request from the CPU 101 is transferred to an I/O interface 206 of the print-out means 200 via the I/O interface 106.

The printer controlling section 200 consists of a CPU 201, a ROM 202 for storing the control program of the CPU 201, and a RAM 203 as a work memory which is necessary during execution of the control program as key units. Furthermore, the printer controlling section 200 has an I/O interface 206 for transferring control signals from the I/O interface 106 of the controller 100 to the CPU 201 and an image data controlling section 204 and a machinery controlling section 205 for controlling the timing of a print producing means 6 by executing each step.

A non-volatile memory 5 and an operator panel 4 are connected to the CPU 101 of the controller 100 and the CPU 201 of the printer controlling section 200 respectively. FIG. 4 shows memory allocation of a part of the non-volatile memory 5. A latest history value (NEWDATA) region 31 is an area where the contents of the relevant memory are updated and stored by the CPU 201 of the printer controlling section 200 every execution of the print sequence. A latest maintenance value (REVDATA) region 32 is an area where the contents of the relevant exchange member memory are updated and stored by the CPU 201 of the print-out means 200 when each exchange member is exchanged.

FIG. 5 shows memory allocation of a part of the ROM 102 of the controller 100 and exchange period values (FIXDATA) 33 which are fixed numbers for exchange period for each exchange member are stored.

Figure 7:
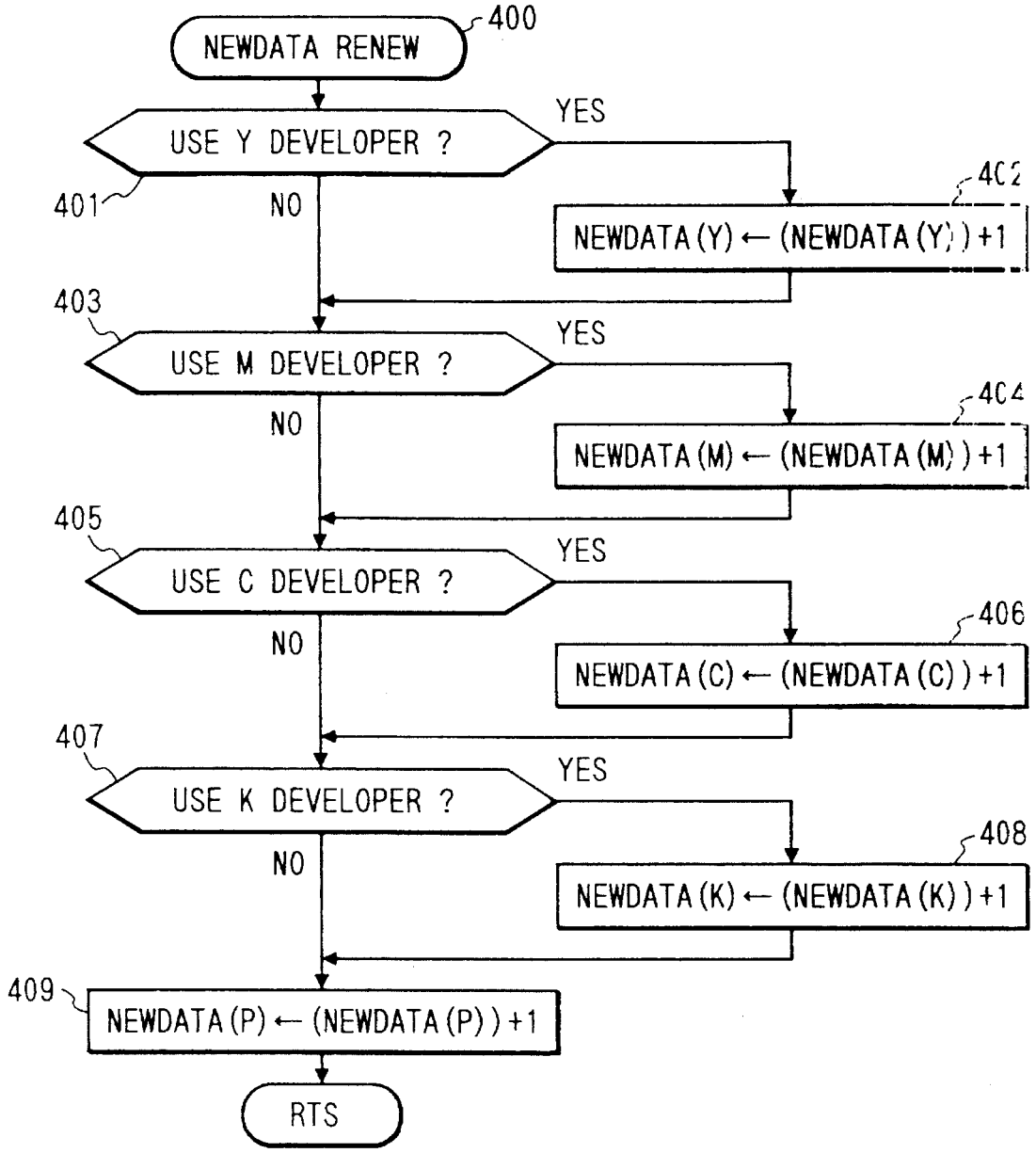
FIG. 7 is a flow chart of the latest history update processing program shown in FIG. 6.
Figure 8:
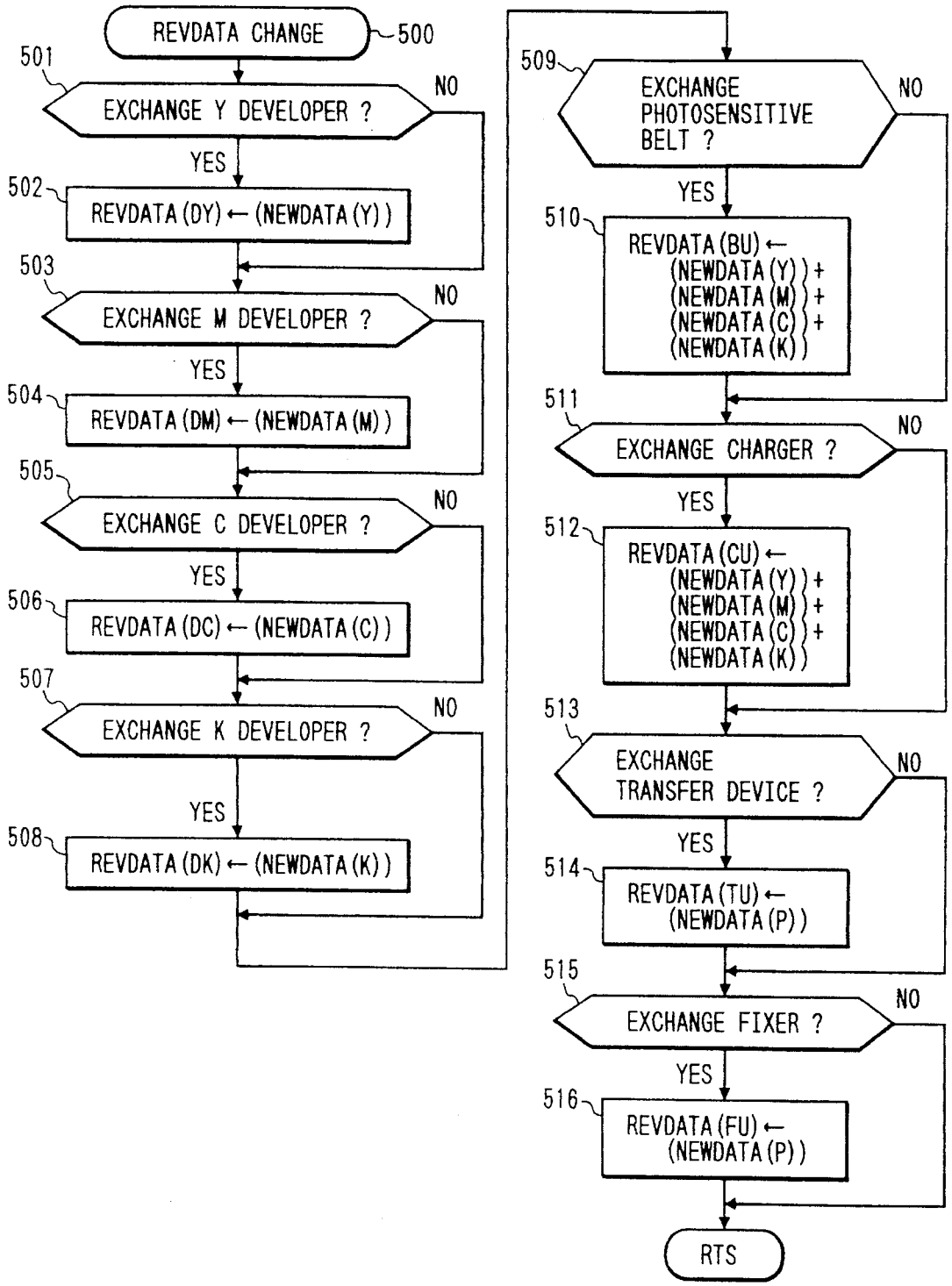
FIG. 8 is a flow chart of the maintenance information storage processing program shown in FIG. 6.

Next, the renewal processing of the latest history values (NEWDATA) 31 of the non-volatile memory 5 (hereinafter referred to as the latest history value renewal processing) and the change processing of the latest maintenance values (REVDATA) 32 of the non-volatile memory 5 (hereinafter referred to as the latest maintenance information storage processing) will be explained with reference to the flow charts shown in FIGS. 6 to 8.

Figure 6:
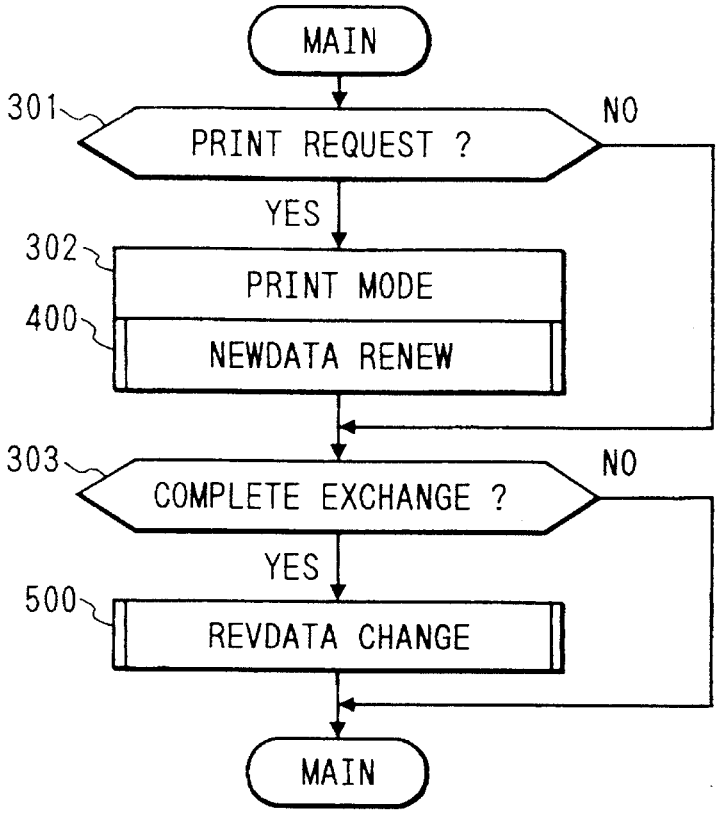
FIG. 6 is a flow chart of the main program which is executed by the print-out means of the control section shown in FIG. 3.

The CPU 201 of the printer controlling section 200 always executes the main program shown in FIG. 6 according to the control program of the ROM 202. In Processing 301, the CPU 201 checks whether a print request is issued from the I/O interface 206. When a print request is issued, the CPU 201 performs the print mode processing 302 for controlling the necessary process and then performs the latest history value renewal processing 400. When it is confirmed by Processing 303 that a notice of exchange completion of each exchange member is inputted from the operator panel 4, the CPU 201 performs the maintenance information storage processing 500.

The latest history value renewal processing 400 will be explained with reference to the flow chart shown in FIG. 7. In the print mode process, the CPU 201 checks whether there is yellow image data using the yellow developer 13 in Processing 401. When there is yellow image data, the CPU 201 renews the content of NEWDATA (Y) to the counted-up value in Processing 402. In Processing 403, the CPU 201 checks whether there is magenta image data using the magenta developer 14. When there is magenta image data, the CPU 201 renews the content of NEWDATA (M) to the counted-up value in Processing 404. In Processing 405, the CPU 201 checks whether there is cyan image data using the cyan developer 15. When there is cyan image data, the CPU 201 renews the content of NEWDATA (C) to the counted-up value in Processing 406. In Processing 407, the CPU 201 checks whether there is black image data using the black developer 16. When there is black image data, the CPU 201 renews the content of NEWDATA (K) to the counted-up value in Processing 408. Finally in Processing 409, the CPU 201 renews the content of NEWDATA (P) to the counted-up value as a number of fed pages. By this control processing, the NEWDATA region of the non-volatile memory 5 can store latest history values 31.

Next, the maintenance information storage processing 500 will be explained with reference to the flow chart shown in FIG. 8. In Processing 501, the CPU 201 checks whether a notice of exchange completion of the yellow developer 13 is inputted. When a notice is inputted, the CPU 201 substitutes and stores the content of NEWDATA (Y) at the time for the content of REVDATA (DY) in Processing 502. In Processing 503, the CPU 201 checks whether a notice of exchange completion of the magenta developer 14 is inputted. When a notice is inputted, the CPU 201 substitutes and stores the content of NEWDATA (M) at the time for the content of REVDATA (DM) in Processing 504. In Processing 505, the CPU 201 checks whether a notice of exchange completion of the cyan developer 15 is inputted. When a notice is inputted, the CPU 201 substitutes and stores the content of NEWDATA (C) at the time for the content of REVDATA (DC) in Processing 506. In Processing 507, the CPU 201 checks whether a notice of exchange completion of the black developer 16 is inputted. When a notice is inputted, the CPU 201 substitutes and stores the content of NEWDATA (K) at the time for the content of REVDATA (DK) in Processing 508.

In Processing 509, the CPU 201 checks whether a notice of exchange completion of the photosensitive belt 10 is inputted. When a notice is inputted, the CPU 201 substitutes and stores the sum of the contents of NEWDATA (Y), NEWDATA (M), NEWDATA (C), and NEWDATA (K) at the time for the content of REVDATA (BU) in Processing 510. Furthermore, in Processing 511, the CPU 201 checks whether a notice of exchange completion of the charger 11 is inputted. When a notice is inputted, the CPU 201 substitutes and stores the sum of the contents of NEWDATA (Y), NEWDATA (M), NEWDATA (C), and NEWDATA (K) at the time for the content of REVDATA (CU) in Processing 512. Furthermore, in Processing 513, the CPU 201 checks whether a notice of exchange completion of the transfer device 21 is inputted. When a notice is inputted, the CPU 201 substitutes and stores the content of NEWDATA (P) at the time for the content of REVDATA (TU) in Processing 514. Also in Processing 515, the CPU 201 checks whether a notice of exchange completion of the fixer 22 is inputted. When a notice is inputted, the CPU 201 substitutes and stores the content of NEWDATA (P) at the time for the content of REVDATA (FU) in Processing 516. By the above processing, the REVDATA region 32 of the nonvolatile memory 5 can always store latest maintenance values.

Figure 10:
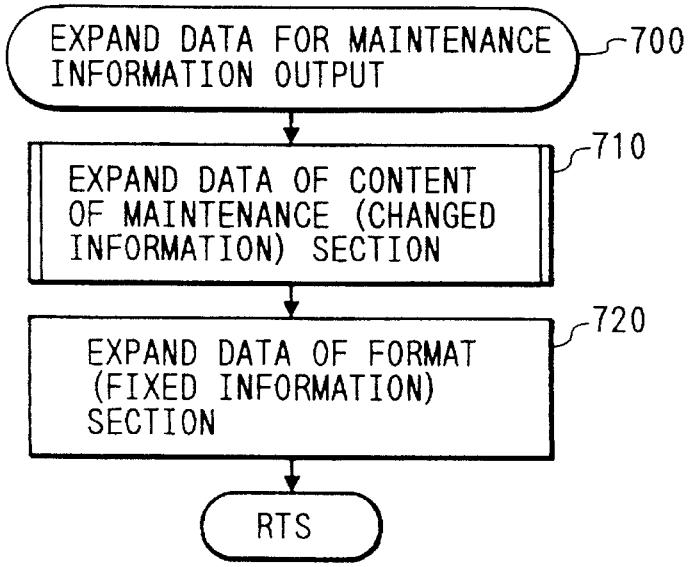
FIG. 10 is a flow chart of the maintenance information output data expansion processing shown in FIG. 9.
Figure 11:
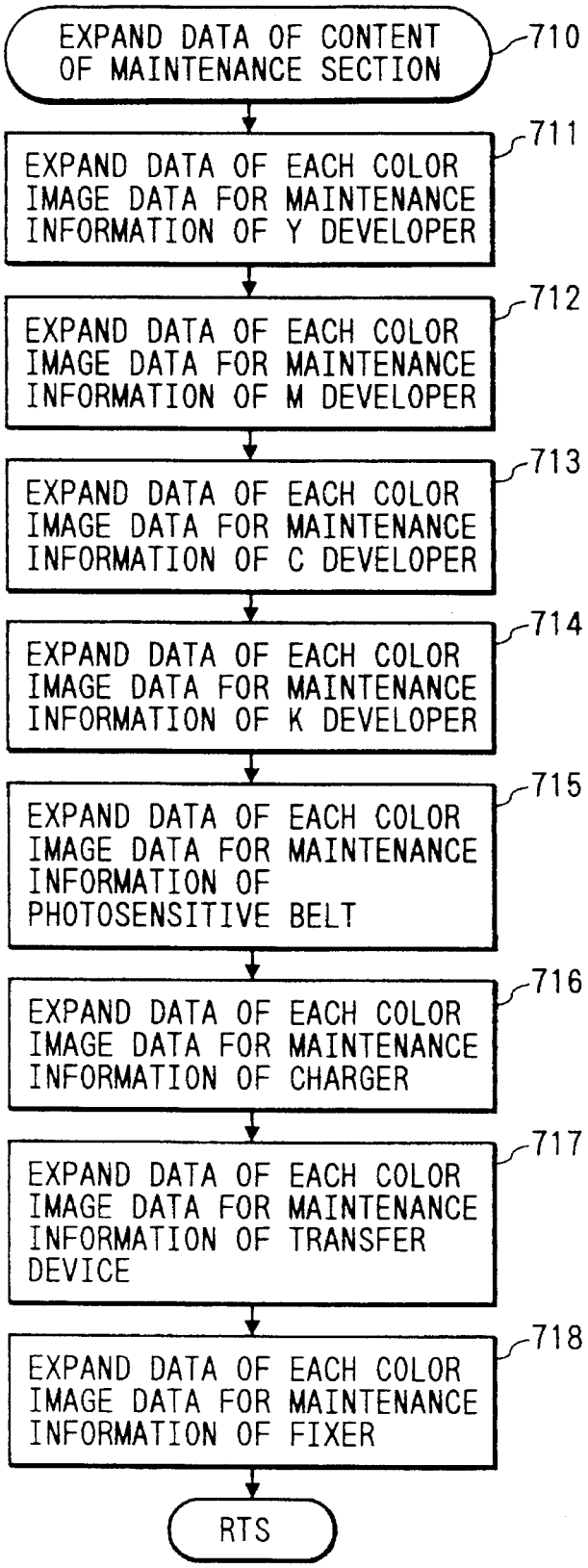
FIG. 11 is a flow chart of the maintenance content data expansion processing shown in FIG. 10.

Next, the processing for realizing a function (hereinafter called the maintenance information output function) for printing maintenance information on the basis of the contents (latest history values 31 and latest maintenance values 32) of the above non-volatile memory 5 and the contents (exchange periods 33) of the ROM 102 on a recording medium in correspondence to an instruction from the operator panel 4 will be explained with reference to the flow charts shown in FIGS. 9 to 11.

Figure 9:
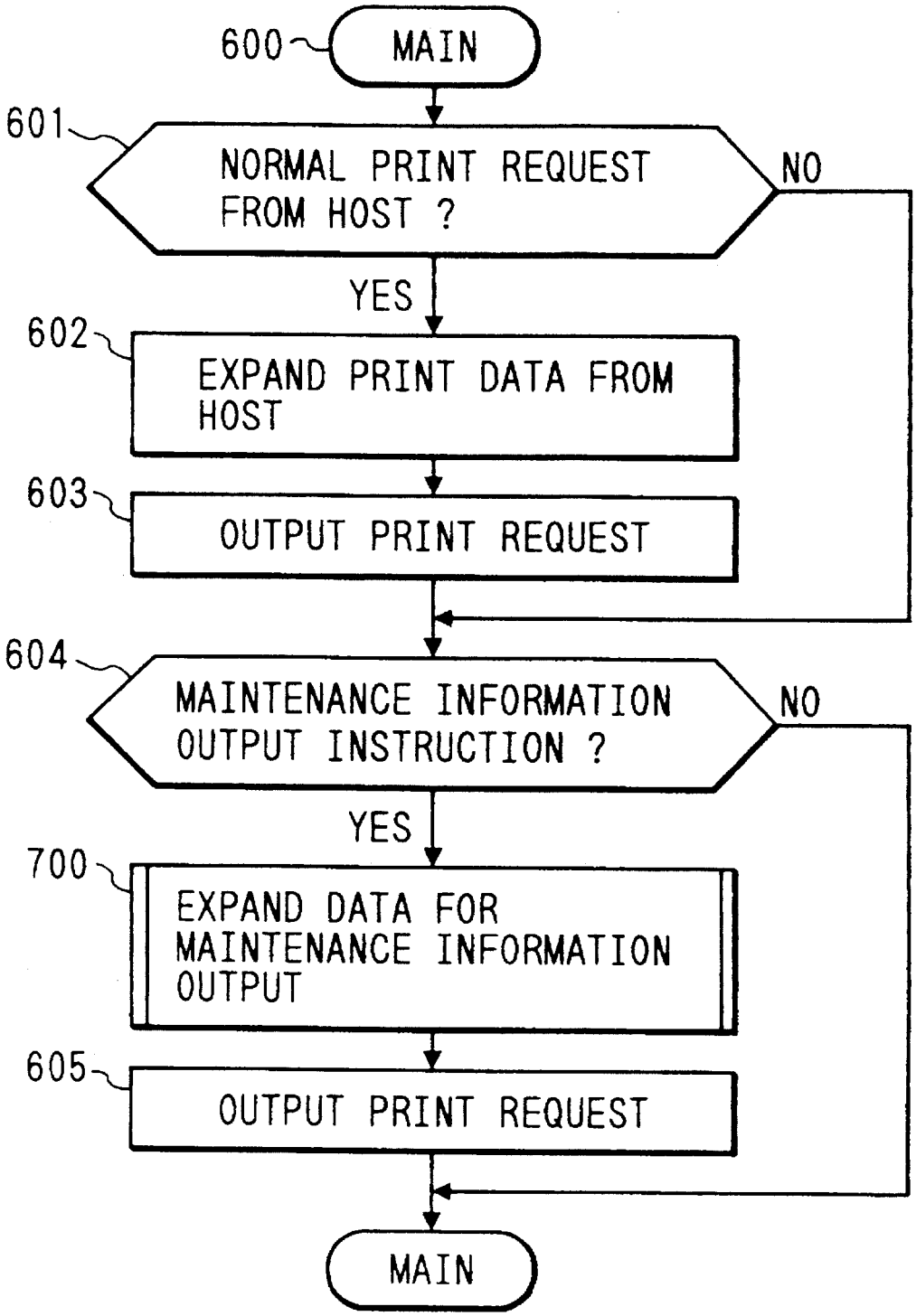
FIG. 9 is a flow chart of the main program which is executed by the controller of the control section shown in FIG. 3.

The CPU 101 of the controller 100 always executes the main program shown in FIG. 9 according to the control program of the ROM 102. In Processing 601, the CPU 101 checks whether a normal print request is inputted from the host computer 2. When a print request is inputted, the CPU 101 expands the print data which is sent from the host computer 2 to image data in each color and stores it in the bit map memory 105 in Processing 602 and then executes Processing 603 for transferring the print request to the I/O interface 206 of the printer controlling section 200 via the I/O interface 106. In Processing 604, the CPU 101 checks whether a maintenance information output instruction is inputted from the operator panel 4. The instruction contains specification of the output destination. When an output instruction is inputted, the CPU 101 expands the maintenance information output data on the basis of the contents (latest history values and latest maintenance values) of the nonvolatile memory 5 and the contents (exchange periods) of the ROM 102 to image data in each color and stores it in the bit map memory 15 in Processing 700. Next, the CPU 101 executes Processing 605 for outputting a print request to the I/O interface 206 of the printer controlling section 200 via the I/O interface 106. In other words, the CPU 101 expands the print data from the host computer 2 for a normal print request or the maintenance information output data of the color printer for a maintenance information output request to image data in each color by the controller 100 and then outputs the print request to the printer controlling section 200.

Next, Processing 700 for expanding the maintenance information output data on the basis of the contents (latest history values and latest maintenance values) of the nonvolatile memory 5 and the contents (exchange periods) of the ROM 102 to image data in each color will be explained with reference to the flow chart shown in FIG. 10. Firstly, in Processing 710, the CPU 101 expands the variable part of the maintenance information output data on the basis of the latest history values 31, latest maintenance values 32, and exchange periods 33 which is stored in the bit map memory 105 (Y data area, M data area, C data area, K data area) after the classification is changed in each color according to the latest history values to image data first (hereinafter called expand data of content of maintenance section). Next in Processing 720, the CPU 101 expands the part in which the expansion destination as image data in each color is fixed by the latest history values 31 (hereinafter called expand data of format section).

The expand data of content of maintenance section processing 710 will be explained with reference to the flow chart shown in FIG. 11. Firstly in Processing 711, the CPU 101 generates data of the maintenance content section of the yellow developer 13. The CPU 101 calculates the sum (the next exchange scheduled value for the yellow developer) of REVDATA (DY) and FIXDATA (DY), reads NEWDATA (Y) (the latest history value for the yellow developer), and compares the next exchange scheduled value for the yellow developer with the latest history value for the yellow developer. When the former is larger than the latter (the value does not reach the next exchange scheduled value), the CPU 101 expands the maintenance information output image data of the yellow developer in the Y and C data areas of the bit map memory 105. In this case, the maintenance information output image color is changed to green. When the latter is larger than the former (the value has reached the next exchange scheduled value), the CPU 101 expands the maintenance information output image data in the Y and M data areas and the maintenance information output image color is changed to red. The format of maintenance information output image data of the yellow developer may be such that, for example, although characters of "yellow developer" are used, the arrival status to the next exchange scheduled value is represented by bar graphs.

Next in Processing 712, the CPU 101 generates data of the maintenance content section of the magenta developer 14. The CPU 101 calculates the sum of REVDATA (DM) and FIXDATA (DM), that is, the next exchange scheduled value for the magenta developer, reads NEWDATA (M) (the latest history value for the magenta developer), and compares the next exchange scheduled value for the magenta developer with the latest history value for the magenta developer. When the former is larger than the latter, that is, the value does not reach the next exchange scheduled value, the CPU 101 expands the maintenance information output image data of the magenta developer in the Y and C data areas of the bit map memory 105 and the maintenance information output image color is changed to green. When the latter is larger than the former, that is, the value has reached the next exchange scheduled value, the CPU 101 expands the maintenance information output image data in the Y and M data areas and the maintenance information output image color is changed to red. Also the format of maintenance information output image data of the magenta developer may be determined by the concept of the format of maintenance information output image data of the above yellow developer.

Next in Processing 713, the CPU 101 generates data of the maintenance content section of the cyan developer 15. The CPU 101 calculates the sum of REVDATA (DC) and FIXDATA (DC), that is, the next exchange scheduled value for the cyan developer, reads NEWDATA (C) (the latest history value for the cyan developer), and compares the next exchange scheduled value for the cyan developer with the latest history value for the cyan developer. When the former is larger than the latter, that is, the value does not reach the next exchange scheduled value, the CPU 101 expands the maintenance information output image data of the cyan developer in the Y and C data areas of the bit map memory 105 and the maintenance information output image color is changed to green. When the latter is larger than the former, that is, the value has reached the next exchange scheduled value, the CPU 101 expands the maintenance information output image data in the Y and M data areas and the maintenance information output image color is changed to red. Also the format of maintenance information output image data of the cyan developer may be determined by the concept of the format of maintenance information output image data of the above yellow developer.

Next in Processing 714, the CPU 101 generates data of the maintenance content section of the black developer 16. The CPU 101 calculates the sum of REVDATA (DK) and FIXDATA (DK), that is, the next exchange scheduled value for the black developer, reads NEWDATA (K) (the latest history value for the black developer), and compares the next exchange scheduled value for the black developer with the latest history value for the black developer. When the former is larger than the latter, that is, the value does not reach the next exchange scheduled value, the CPU 101 expands the maintenance information output image data of the black developer in the Y and C data areas of the bit map memory 105 and the maintenance information output image color is changed to green. When the latter is larger than the former, that is, the value has reached the next exchange scheduled value, the CPU 101 expands the maintenance information output image data in the Y and M data areas and the maintenance information output image color is changed to red. Also the format of maintenance information output image data of the black developer may be determined by the concept of the format of maintenance information output image data of the above yellow developer.

Next in Processing 715, the CPU 101 generates data of the maintenance content section of the photosensitive belt 10. The CPU 101 calculates the sum of REVDATA (BU) and FIXDATA (BU), that is, the next exchange scheduled value for the photosensitive belt, calculates the sum of NEWDATA (Y), NEWDATA (M), NEWDATA (C), and NEWDATA (K), that is, the latest history value for the photosensitive belt, and compares the next exchange scheduled value for the photosensitive belt with the latest history value for the photosensitive belt. When the former is larger than the latter, that is, the value does not reach the next exchange scheduled value, the CPU 101 expands the maintenance information output image data of the photosensitive belt in the Y and C data areas of the bit map memory 105 and the maintenance information output image color is changed to green. When the latter is larger than the former, that is, the value has reached the next exchange scheduled value, the CPU 101 expands the maintenance information output image data in the Y and M data areas and the maintenance information output image color is changed to red. Also the format of maintenance information output image data of the photosensitive belt may be determined by the concept of the format of maintenance information output image data of the above yellow developer.

Next in Processing 716, the CPU 101 generates data of the maintenance content section of the charger 11.

The CPU 101 calculates the sum of REVDATA (CU) and FIXDATA (CU), that is, the next exchange scheduled value for the charger, calculates the sum of NEWDATA (Y), NEWDATA (M), NEWDATA (C), and NEWDATA (K), that is, the latest history value for the charger, and compares the next exchange scheduled value for the charger belt with the latest history value for the charger. When the former is larger than the latter, that is, the value does not reach the next exchange scheduled value, the CPU 101 expands the maintenance information output image data of the charger in the Y and C data areas of the bit map memory 105 and the maintenance information output image color is changed to green. When the latter is larger than the former, that is, the value has reached the next exchange scheduled value, the CPU 101 expands the maintenance information output image data in the Y and M data areas and the maintenance information output image color is changed to red. Also the format of maintenance information output image data of the charger may be determined by the concept of the format of maintenance information output image data of the above yellow developer.

Next in Processing 717, the CPU 101 generates data of the maintenance content section of the transfer device 21. The CPU 101 calculates the sum of REVDATA (TU) and FIXDATA (TU), that is, the next exchange scheduled value for the transfer device, reads NEWDATA (P) (the latest history value for the transfer device), and compares the next exchange scheduled value for the transfer device with the latest history value for the transfer device. When the former is larger than the latter, that is, the value does not reach the next exchange scheduled value, the CPU 101 expands the maintenance information output image data of the transfer device in the Y and C data areas of the bit map memory 105 and the maintenance information output image color is changed to green. When the latter is larger than the former, that is, the value has reached the next exchange scheduled value, the CPU 101 expands the maintenance information output image data in the Y and M data areas and the maintenance information output image color is changed to red. Also the format of maintenance information output image data of the transfer device may be determined by the concept of the format of maintenance information output image data of the above yellow developer.

Finally in Processing 718, the CPU 101 generates data of the maintenance content section of the fixer 22. The CPU 101 calculates the sum of REVDATA (TU) and FIXDATA (TU), that is, the next exchange scheduled value for the fixer, reads NEWDATA (P) (the latest history value for the fixer, and compares the next exchange scheduled value for the fixer with the latest history value for the fixer. When the former is larger than the latter, that is, the value does not reach the next exchange scheduled value, the CPU 101 expands the maintenance information output image data of the fixer in the Y and C data areas of the bit map memory 105 and the maintenance information output image color is changed to green. When the latter is larger than the former, that is, the value has reached the next exchange scheduled value, the CPU 101 expands the maintenance information output image data in the Y and M data areas and the maintenance information output image color is changed to red. Also the format of maintenance information output image data of the fixer may be determined by the concept of the format of maintenance information output image data of the above yellow developer.

Figure 13:
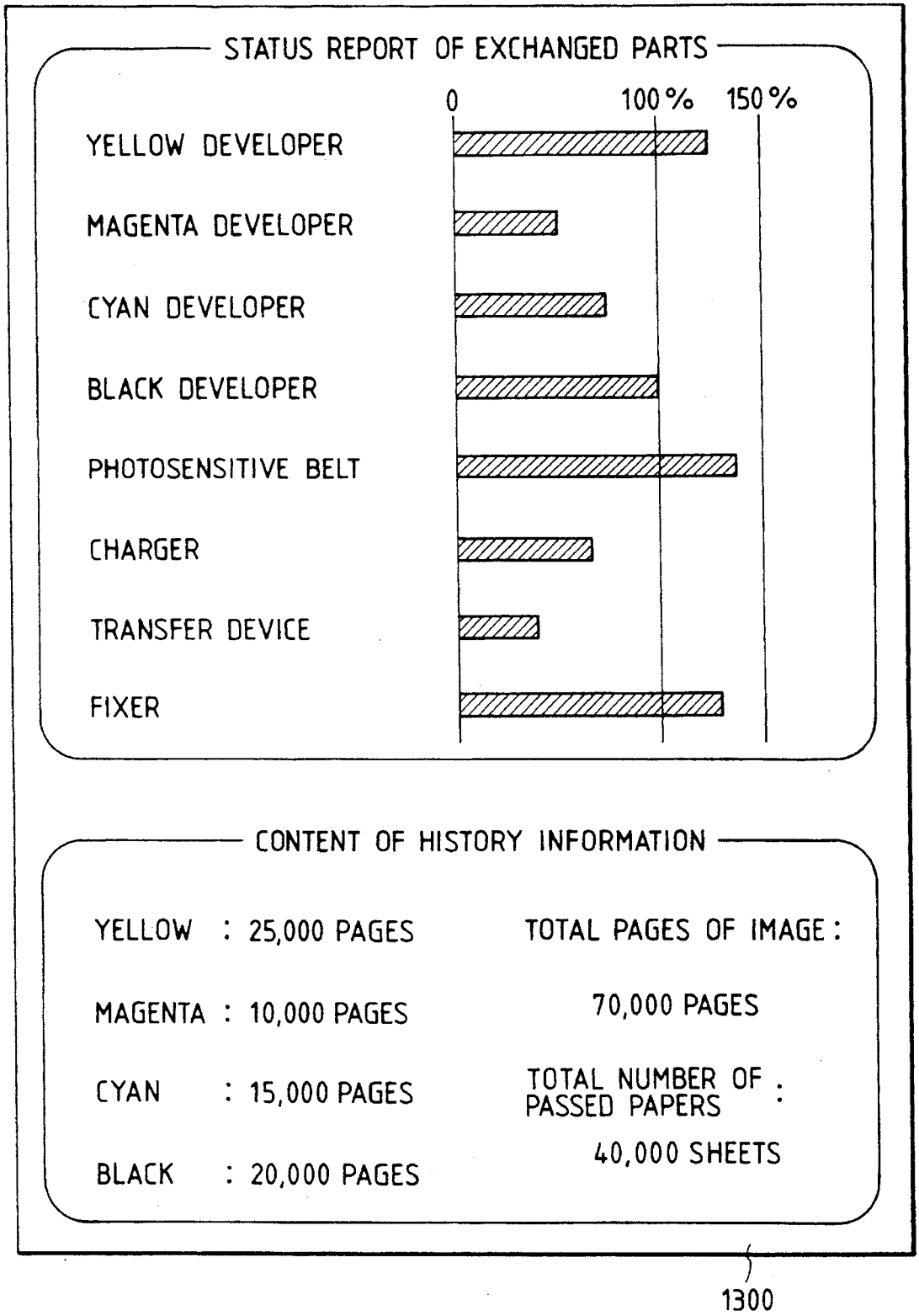
FIG. 13 is an illustration of an information print-out image example using bar graphs.

Print-out image examples of image data which is expanded by the maintenance information output function like this are shown in FIGS. 12 and 13. As to data when the print-out is executed, the latest history value of NEWDATA (Y) is 25000 pages, and that of NEWDATA (M) is 10000 pages, and that of NEWDATA (C) is 15000 pages, and that of NEWDATA (K) is 20000 pages, and that of NEWDATA (P) is 40000 sheets, and the latest maintenance values are all 0. The exchange periods of FIXDATA (DY), FIXDATA (DM), FIXDATA (DC), and FIXDATA (DK) are 20000 pages each, and that of FIXDATA (BU) is 50000 pages, and those of FIXDATA (CU) and FIXDATA (TU) are 100000 pages each, and that of FIXDATA (FU) is 30000 sheets.

Figure 14:
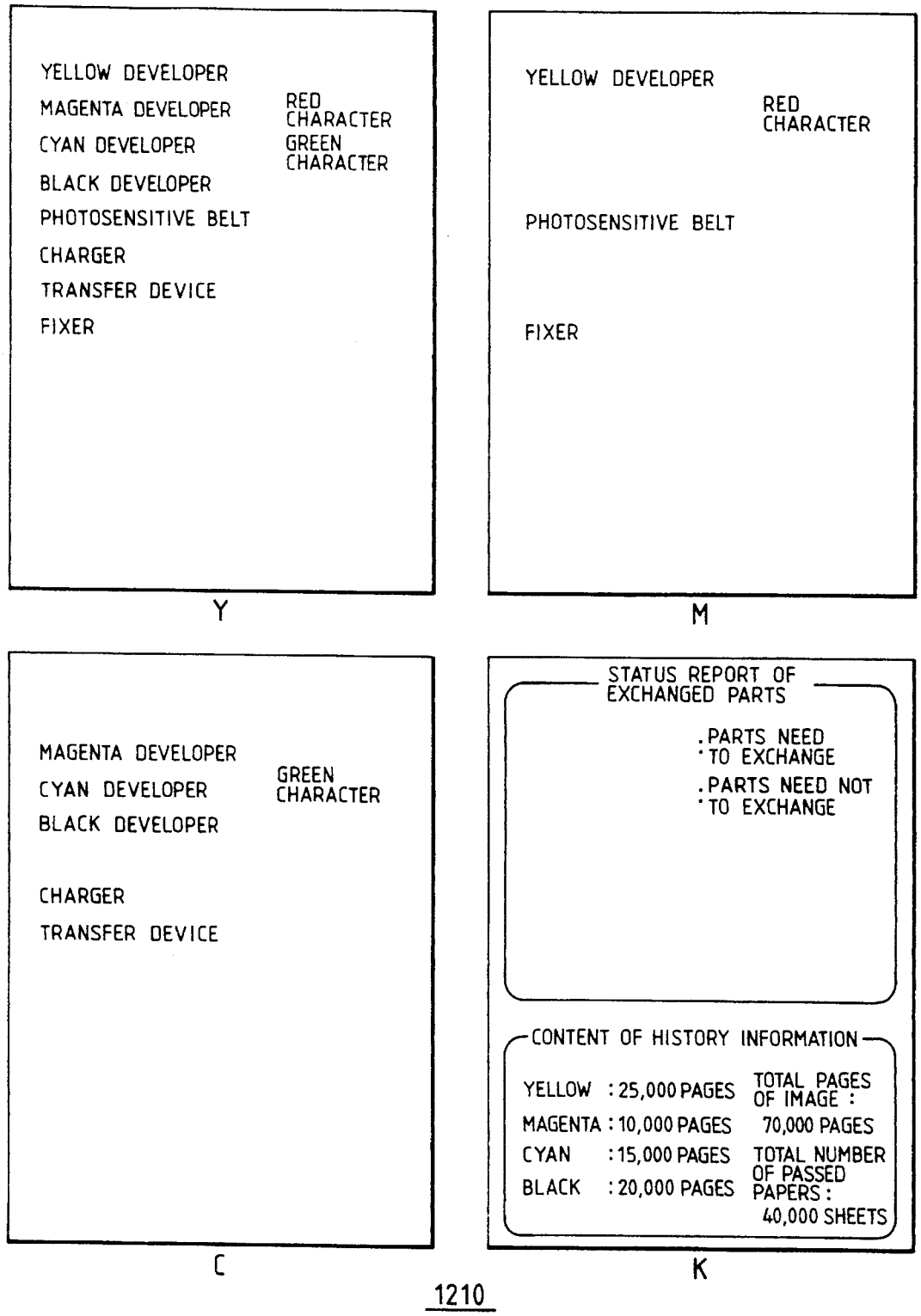
FIG. 14 is an illustration of image data expanded in the bit map memory for information print-out using characters.

FIG. 12 shows an example of a print-out image 1200 by "Character representation". The print images of part names to be exchanged are displayed in red and the print images of part names not to be exchanged are displayed in green. Image data 1210 in each color on the bit map memory 105 in the output example 1200 is shown in FIG. 14. In the drawing, "Yellow developer", "Photosensitive belt", "Fixer", and "Red character" are displayed as red images and "Magenta developer", "Cyan developer", "Black developer", "Charger", "Transfer device", and "Green character" are displayed as green images.

Figure 15:
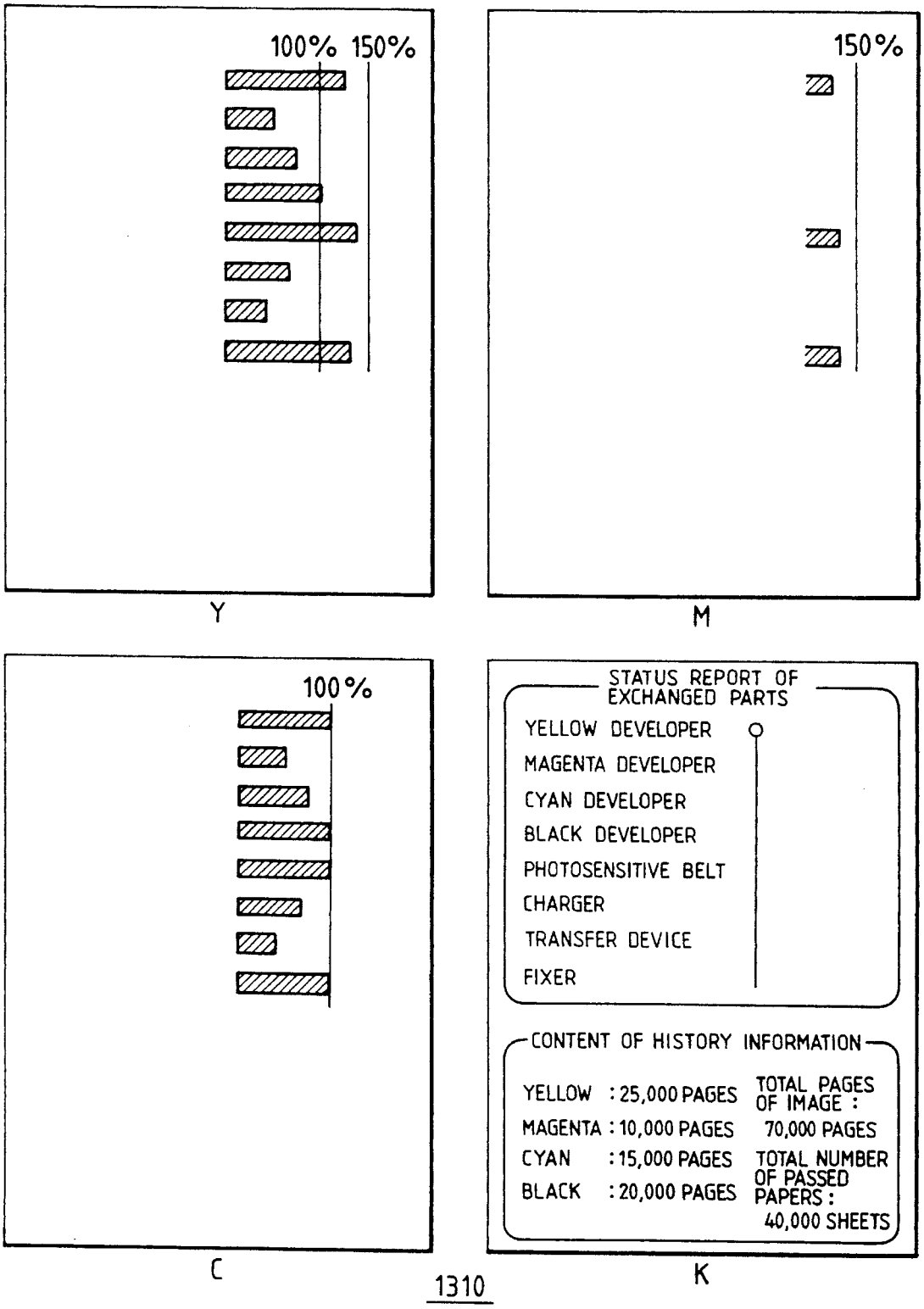
FIG. 15 is an illustration of image data expanded in the bit memory for information print-out using bar graphs.

FIG. 13 shows an example of an output image 1300 by "Bar graph representation". The part of at most 100% of each bar graph indicating the arrival status to the next exchange scheduled value for each part to be exchanged is displayed in green and the part of more than 100% is displayed in red. Image data 1310 in each color on the bit map memory 105 in the output example 1300 is shown in FIG. 15. Needless to say, in place of the bar graph representation of the output image 1300, the arrival status may be displayed by other graphic representation.

According to the above embodiment of the present invention, a latest maintenance information output image for maintenance and inspection of a color printer or for exchange of expendable members is printed in color on a recording medium, so that the maintenance and inspection and the exchange of expendable members can be simplified extremely and the maintenance cost can be reduced substantially.

The operability for obtaining information for maintenance and inspection or exchange of expendable members can be improved remarkably.

Furthermore, the printer prints information images on recording media which are used ordinarily, so that the operator panel requires no parts such as a character display unit, and the reliability is increased, and the cost is decreased.

Next, another embodiment of the present invention will be explained with reference to FIGS. 16 and 17. According to this embodiment, the color printer which is explained in the previous embodiment is used as a printer server for workstations.

Figure 16:
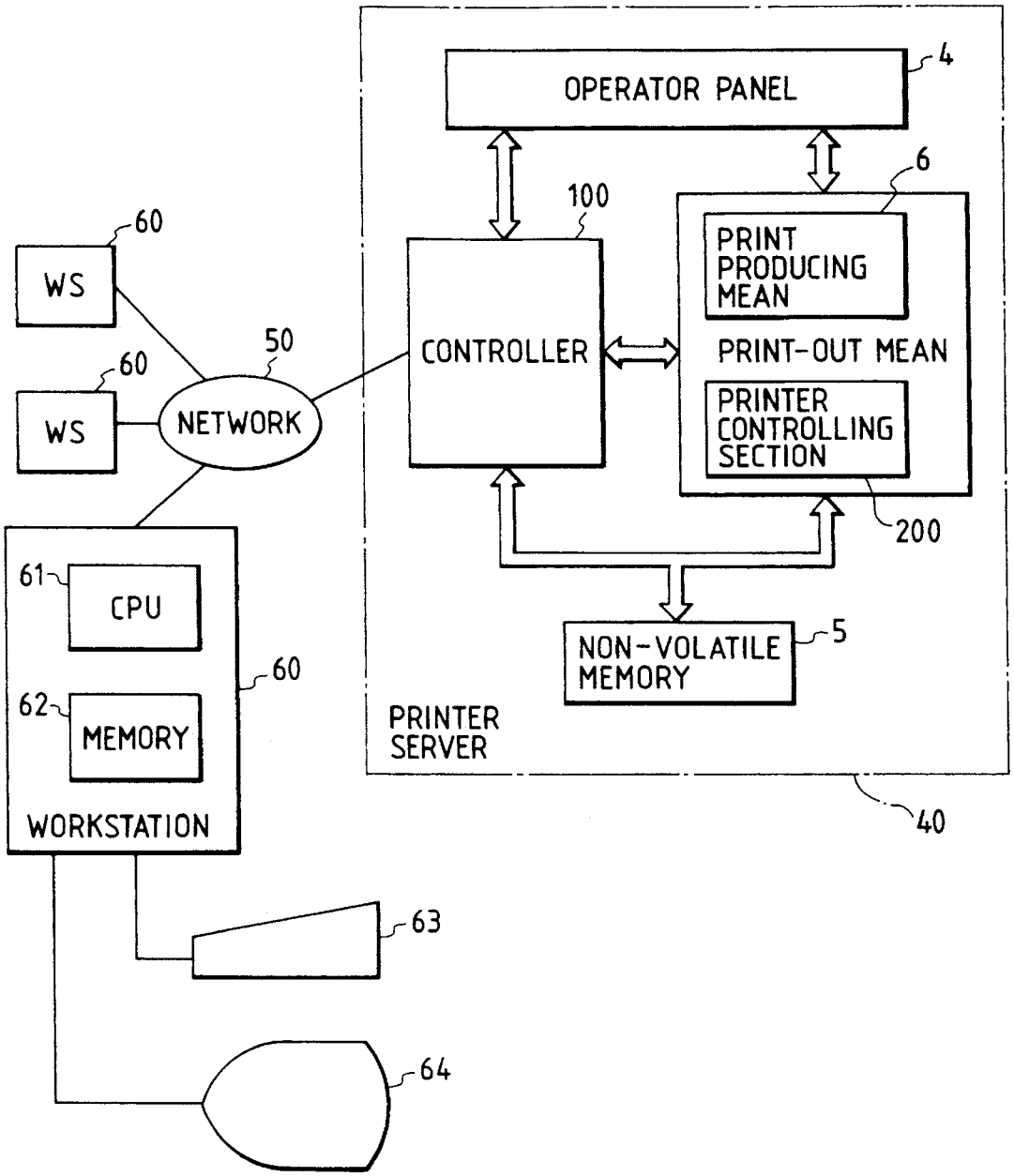
FIG. 16 is an entire block diagram of a printer server of another embodiment of the present invention.

In FIG. 16, numeral 40 indicates a printer server having a structure which is the same as that of the color printer 1 shown in FIG. 1. The printer server is connected to a plurality of workstations via a communication network 50. Each workstation includes a CPU 61, a memory 62, an input device 63, and a display device 64 and has a function that when the maintenance and inspection of the printer server 40 are performed and an expendable member or exchange member is exchanged, an instruction for storing the latest maintenance values of the above member is outputted to the printer controlling section 200 in the same way as the operator panel 4. Furthermore, each workstation has a function for instructing the controller 100 to print maintenance information on the basis of the latest history values and latest maintenance values, which are necessary for performing maintenance and inspection and exchanging expendable members or exchange members, on a recording medium. These functions can be obtained by executing the programs in the memory 62 by the CPU 61.

The workstations 60 may have a part of the functions of the printer 1 shown in FIG. 1. For example, using the memory 62 of each workstation or an auxiliary memory in place of the memory 5, the CPU 61 of each workstation may execute a part of various types of processing which are executed by the CPU 101 of the controller 100.

Figure 17:
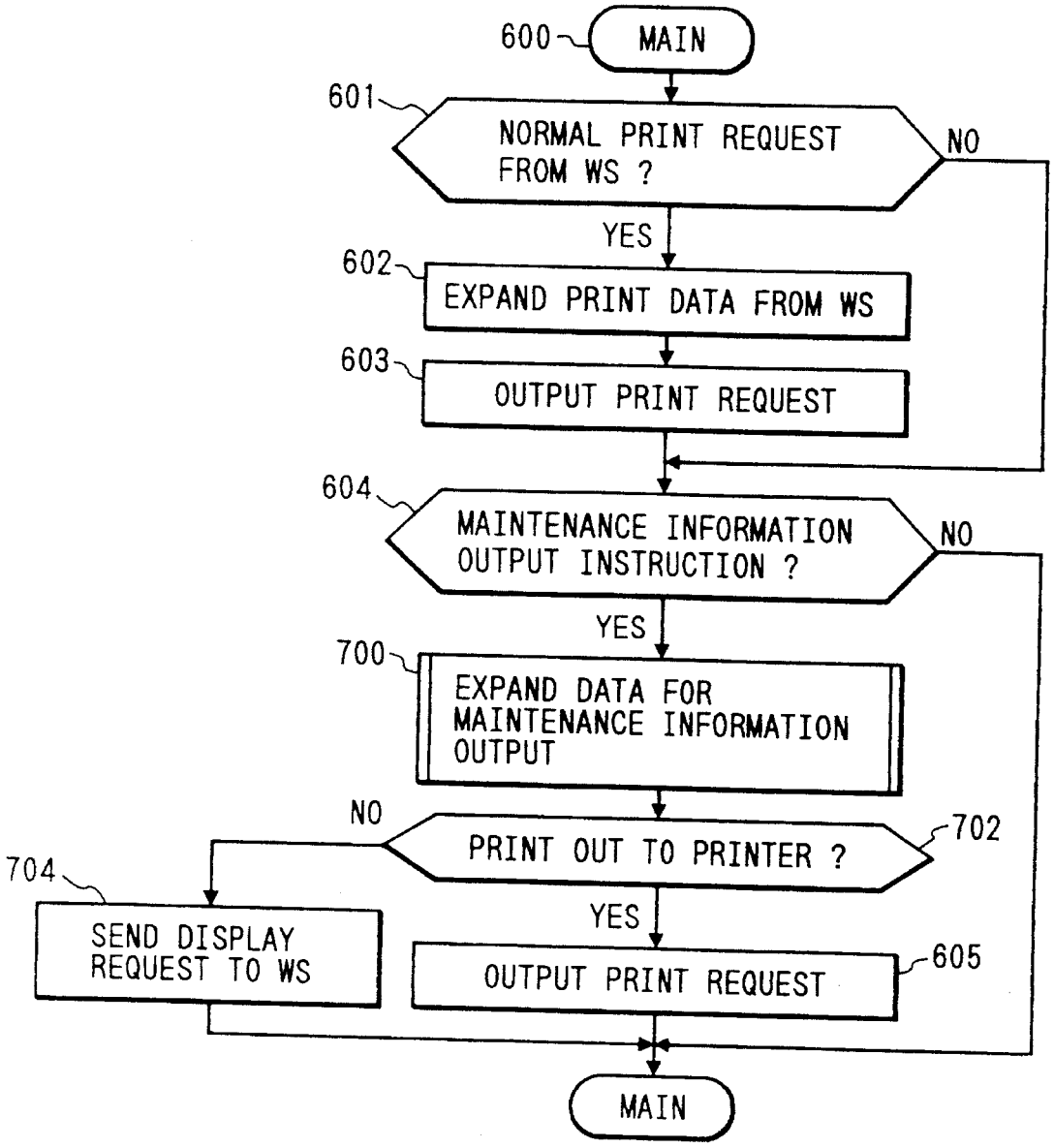
FIG. 17 is a flow chart of the main processing of the controller shown in FIG. 16.

FIG. 17 is a flow chart of the main program 600 of this embodiment. In Processing 601, the CPU 61 checks whether a normal print request is inputted from any of the workstations 60. When a print request is inputted, the CPU 61 expands the print data sent from the workstation 60 to image data in each color in Processing 602 and stores it in the bit map memory 105 and then executes Processing 603 for transferring the print request to the I/O interface 206 of the printer controlling section 200 via the I/O interface 106. In Processing 604, the CPU 61 checks whether a maintenance information output instruction is inputted. The instruction contains specification of the output destination. When an output instruction is inputted, the CPU 61 expands the maintenance information output data on the basis of the contents (latest history values and latest maintenance values) of the memory 5 and the contents (exchange periods) of the ROM 102 to image data in each color and stores it in the bit map memory 15 in Processing 700. Then, the CPU 61 checks the maintenance information output destination (Processing 702). When the output destination is the printer, the CPU 61 executes Processing 605 for outputting a print request to the I/O interface 206 of the printer controlling section 200 via the I/O interface 106. When the output destination is the workstation 60, the CPU 61 displays the maintenance information and history information on the display device 64. The display format is the same as that of the output image 1200 or 1300 shown in FIG. 12 or 13.

Also in this embodiment, maintenance information necessary for performing maintenance and inspection or for exchanging expendable members can be outputted in a color image form which is color-coded quite obviously. Therefore, a user can perform the maintenance and inspection operation and the exchange operation of expendable members efficiently and precisely and the maintenance operation cost can be reduced.

What is claimed is:

1. A color printer including a controller having an image data generating section for generating color image data, a print-out means for printing said image data in color, and an operator panel having an instruction function for initiating functions on said controller and print-out means, said color printer comprising:

a first memory means for storing latest history information for each of a predetermined number of expendable members of said print-out means;

a second memory means for storing an exchange time for each of said expendable members;

a worn condition judging section for judging a worn condition of each of said expendable members based on said history and exchange time information;

a maintenance information image data generating section for:

(a) sorting said expendable members into a first group of expendable members which have not reached their respective exchange times and a second group of expendable members which have reached or exceeded their respective exchange times, (b) generating maintenance information image data for representing said groups in different colors, and (c) generating, based on said worn condition for each of said members, degree-of-wear image data for representing a degree-of-wear for each of said members; and a maintenance information output section for outputting said maintenance information image data and the degree-of-wear image data to said print-out means for printing said maintenance information image data in said different colors on a first recording medium, and for printing said degree-of-wear image data on a second recording medium relative to the exchange time of each member.

2. A color printer including a controller having an image data generating section for generating color image data, a print-out means for printing said image data in color, and an operator panel having an instruction function for said controller and print-out means, said color printer comprising:

a first memory means for storing a plurality of types of history information for each of a predetermined number of expendable members of said print-out means;

a second memory means for storing an exchange time for each of said expendable members;

a worn condition judging section for judging a worn condition of each of said expendable members based on said history and exchange time information;

a maintenance information image data generating section for:

(a) generating maintenance information image data for representing said history information, (b) sorting said expendable members into a first group of expendable members which have not reached their respective exchange times and a second group of expendable members which have reached or exceeded their respective exchange times, and (c) generating, based on said worn condition for each of said members, degree-of-wear image data for representing a degree-of-wear for each of said members; and a maintenance information print instructing section for instructing said print-out means to print said maintenance information image data and the degree-of-wear image data on a recording medium, said maintenance information image data being printed in color and said degree-of-wear image data being printed relative to the exchange time of each expendable member.

3. A color printer according to claim 2, wherein said maintenance information print instructing section prints maintenance information image data which is sorted to the first group of expendable members in a color selected to indicate that the expendable members in said first group have not reached their respective exchange times, and prints maintenance information image data which is sorted to the second group in a color selected to indicate that the expendable members in said second group have reached or exceeded their respective exchange times.

4. A color printer according to claim 2, wherein said maintenance information print instructing section instructs said print-out means to print the degree-of-wear image data for each of said expendable members in bar graph form on said recording medium.

5. A printer server including a controller having an image data generating section for generating color image data and a print-out means for printing said data on a recording medium in color, said image data generating section generating said color image data in colors determined by color print data sent from an external host computer and input into said print-out means, said printer server comprising:

a first memory means for storing latest history information for each of a predetermined number of expendable members of said print-out means, a second memory means for storing an exchange time for each of said expendable members a worn condition judging section for judging a worn condition of each of said expendable members based on said history and exchange time information, a maintenance information image data generating section for:

(a) sorting said expendable members into a first group of expendable members which have not reached their respective exchange times and a second group of expendable members which have reached or exceeded their respective exchange times, (b) generating maintenance information image data for representing said groups in different colors, and (c) generating, based on said worn condition for each of said members, degree-of-wear image data for representing a degree-of-wear for each of said members; and a maintenance information output section for outputting said maintenance information image data to the display device of said host computer;

a maintenance information output section for outputting said maintenance information image data and the degree-of-wear image data to the display device of said host computer, said maintenance information image data being displayed in said different colors and said degree-of-wear image data being printed relative to the exchange time of each member.

6. A printer server including a controller having an image data generating section for generating color image data and a print-out means for printing said image data in color, said image data generating section determined by color print data sent from an external host computer and input into said print-out means, said printer server comprising:

a first memory means for storing latest history information of said point-out means;

a second memory means for storing an exchange time for each of said expendable members;

a worn condition judging section for judging a worn condition of each of said expendable members based on said history and exchange time information;

a maintenance information image data generating section for:

(a) sorting said expendable members into a first group which have not reached their respective exchange times and a second group which have reached or exceeded their respective exchange times, (b) generating maintenance information image data for representing said groups in different colors, and (c) generating, based on said worn condition for each of said members, degree-of-wear image data for representing a degree-of-wear for each of said members; and a maintenance information print instructing section for instructing said print-out means to print said maintenance information image data on a first recording medium in said different colors, and for printing said degree-of-wear image data on a second recording medium relative to the exchange time of each expendable member.

7. A method for outputting maintenance information of a color printer, said printer including a controller having an image data generating section for generating color image data, a print-out means for printing said image data in color, and an operator panel having an instruction function for controlling said print-out means, said method comprising the steps of:

storing latest history information for each of a predetermined number of expendable members of said print-out means in a first memory means, storing an exchange time for each of said expendable members in a second memory means judging a worn condition of each of said expendable members based on said history and exchange time information;

sorting said expendable members into a first group which have not reached their respective exchange times and a second group which have reached or exceeded their respective exchange times;

generating maintenance information image data for representing said groups in different colors;

generating, based on said worn condition for each of said members, degree-of-wear image data for representing a degree-of-wear for each of said members;

printing said maintenance information image data on a first recording medium in said different colors by said print-out means; and printing said degree-of-wear image data on a second recording medium relative to the exchange time of each member.

8. A method for outputting maintenance information of a color printer, said printer including an image data generating section for generating color image data, a print-out means for printing said image data in color, and an operation means for controlling said print-out means, said method comprising the steps of:

storing latest history information for each of a predetermined number of expendable members of said print-out means in a first memory means, storing an exchange time for each of said expendable members in a second memory means judging a worn condition of each of said expendable members based on said history and exchange time information;

generating maintenance information image data for representing said history information;

sorting said expendable members into a first group which have not reached their respective exchange times and a second group which have reached or exceeded their respective exchange times;

generating, based on said worn condition for each of said members, degree-of-wear image data for representing a degree-of-wear for each of said members; and printing said maintenance information image data and said degree-of-wear image data on a recording medium by said print-out means, said maintenance information image data being printed in color and said degree-of-wear image data being printed relative to the exchange time of each expendable member.

9. A method as recited in claims 7 or 8, wherein said maintenance information image data corresponding to said first group of expendable members are printed in a color selected to indicate that the members in said first group have not reached their respective exchange times and said maintenance information image data corresponding to said second group of expandable members are printed in a color selected to indicate that the members in said second group have reached or exceeded their respective exchange times.

10. A method for outputting maintenance information of a printer server, said server including a controller having an image data generating section for generating color image data and a print-out means for printing said image data in color, said image data generating section generating said data in colors determined by color print data sent from an external host computer input into said print-out means, said method comprising the steps of:

storing latest history information for each of a predetermined number of expendable members of said print-out means in a first memory means, storing an exchange time for each of said expendable members in a second memory means;

judging a worn condition of said expendable members based on said history and exchange time information;

generating maintenance information image data for representing said history information;

sorting said expendable members into a first group which have not reached their respective exchange times and a second group which have reached or exceeded their respective exchange times;

generating, based on said worn condition for each of said members, degree-of-wear image data for representing a degree-of-wear for each of said members; and printing said maintenance information image data and said degree-of-wear image data on a recording medium by said print-out means, said maintenance information image data being printed in color and said degree-of-wear image data being printed relative to the exchange time of each expendable member.

11. A method for outputting maintenance information of a printer server, including a controller having an image data generating section for generating color image data and a print-out means for printing said image data on a recording medium in colors, said image data generating section generating color image data in colors determined by color print data sent from an external host computer and input into said print-out means, said method comprising the steps of:

storing latest history information for each of a predetermined number of expendable members of said print-out means in a first memory means, storing an exchange time for each of said expendable members in a second memory means;

judging a worn condition of said expendable members based on said history and exchange time information;

generating maintenance information image data for representing said history information;

sorting said expendable members into a first group which have not reached their respective exchange times and a second group which have reached or exceeded their respective exchange times, and generating, based on said worn condition for each of said members, degree-of-wear image data for representing a degree-of-wear for each of said members; and outputting said maintenance information image data and said degree-of-wear image data to the display device of said host computer, said maintenance information image data being printed in color and said degree-of-wear image data being printed relative to the exchange time of each expendable member.

12. A color printer as recited in claims 1 or 2, wherein said color printer continues to be operational even though one or more of said expendable members have exceeded their respective exchange times.

13. A printer server as recited in claims 5 or 6, wherein said server continues to be operational even though one or more of said expendable members have exceeded their respective exchange times.

14. A color printer including a controller having an image data generating section for generating color image data, a print-out means for printing said image data in color, and an operator panel having an instruction function for initiating functions on said controller and print-out means, said color printer comprising:

a memory means for storing latest history information for each of a predetermined number of expendable members of said print-out means;

a worn condition judging section for judging a worn condition of each of said expendable members based on said history information;

a maintenance information image data generating section for:

(a) sorting said expendable members into a first group of expendable members which have not reached their respective exchange times and a second group of members which have reached or exceeded their respective exchange times, (b) generating maintenance information image data for representing said first group in a first color and said second group in a second color, and a maintenance information output section for outputting said maintenance information image data to said print-out means for printing image data on a recording medium in said first and second colors.

15. The color printer recited in claim 14, further comprising:

a second memory means for storing an exchange time for each of said expendable members, said worn condition judging section determining a worn condition of each of said expendable members by comparing said history information to the exchange time for each member.

16. The color printer recited in claim 15, wherein said maintenance information generating section generates degree-of-wear image data for each of said members based on said comparison, and further wherein said maintenance information output section outputs said degree-of-wear image data to said print-out means for printing on a different recording medium relative to the exchange time of each member.

17. A printer server including a controller having an image data generating section for generating color image data and a print-out means for printing said data on a recording medium in color, said image data generating section generating said color image data in colors determined by color print data sent from an external host computer and input into said print-out means, said printer server comprising:

a memory means for storing latest history information for each of a predetermined number of expendable members of said print-out means;

a worn condition judging section for judging a worn condition of each of said expendable members based on said history information;

a maintenance information image data generating section for:

(a) sorting said expendable members into a first group of expendable members which have not reached their respective exchange times and a second group of members which have reached or exceeded their respective exchange times, (b) generating maintenance information image data for representing said first group in a firs color and said second group in a second color, and a maintenance information output section for outputting said maintenance information image data to said print-out means for printing image data on a recording medium in said first and second colors.

18. The printer server recited in claim 17, further comprising:

a second memory means for storing an exchange time for each of said expendable members, said worn condition judging section determining a worn condition of each of said expendable members by comparing said history information to the exchange time for each member.

19. The printer server recited in claim 18, wherein said maintenance information generating section generates degree-of-wear image data for each of said members based on said comparison, and further wherein said maintenance information output section outputs said degree-of-wear image data to said print-out means for printing on a different recording medium relative to the exchange time of each member.

20. A method for outputting maintenance information of a color printer, said printer including a controller having an image data generating section for generating color image data, a print-out means for printing said image data in color, and an operator panel having an instruction function for controlling said print-out means, said method comprising:

storing latest history information for each of a predetermined number of expendable members of said print-out means in a first memory means, judging a worn condition of each of said expendable members based on said history and exchange time information;

sorting said expendable members into a first group which have not reached their respective exchange times and a second group which have reached or exceeded their respective exchange times;

generating maintenance information image data for representing said first group in first color said second group in a second color;

printing said maintenance information image data on a recording medium in said different colors.

* * * * *